US005803420A

United States Patent [19]

Conway et al.

[11] Patent Number: 5,803,420

[45] Date of Patent: Sep. 8, 1998

[54] UNIVERSAL SIGN MOUNTING DEVICE

[75] Inventors: Thomas M. Conway, Chicago; Scott Padiak, Winnetka, both of Ill.

[73] Assignee: Cormark, Inc., Rosemont, Ill.

[21] Appl. No.: 614,470

[22] Filed: Mar. 13, 1996

[51] Int. Cl.[6] ..... G09F 7/08

[52] U.S. Cl. ..... 248/231.41; 40/611; 248/291.1

[58] Field of Search ..... 248/231.41, 228.3, 248/291.1, 286.1, 316.4, 220.41; 40/492, 611, 642.01, 606

[56] References Cited

U.S. PATENT DOCUMENTS

| | | | |
|---|---|---|---|
| 268,616 | 12/1882 | Brown | 248/231.41 X |
| 1,111,458 | 9/1914 | Hight . | |
| 1,220,758 | 3/1917 | Lamphiear | 248/291.1 X |
| 2,787,433 | 4/1957 | Slavsky et al. . | |
| 2,845,729 | 8/1958 | Baumgart | 40/492 X |
| 3,082,989 | 3/1963 | Bower | 248/286.1 |
| 3,669,392 | 6/1972 | Saunders | 248/316.4 X |
| 4,369,948 | 1/1983 | Krauss et al. | 248/291.1 X |
| 4,798,013 | 1/1989 | Sainato | 248/220.41 X |
| 4,869,376 | 9/1989 | Valiulis | 248/220.41 X |
| 4,881,707 | 11/1989 | Garfinkle . | |
| 4,909,464 | 3/1990 | Levine et al. . | |
| 5,044,104 | 9/1991 | Hopperdietzel | 40/654.01 |
| 5,106,046 | 4/1992 | Rowles | 248/231.41 X |
| 5,230,174 | 7/1993 | Reed . | |
| 5,237,767 | 8/1993 | Kringel et al. . | |
| 5,383,793 | 1/1995 | Hsu et al. | 248/316.4 X |
| 5,408,775 | 4/1995 | Abramson et al. . | |
| 5,472,289 | 12/1995 | Kringel et al. . | |

*Primary Examiner*—Derek J. Berger
*Attorney, Agent, or Firm*—Garden, Carton & Douglas

[57] ABSTRACT

The present invention discloses a universal device to attach signs to a various types of shelving units while providing access to all the shelf space. The device includes a bracket that removably connects to the shelf and a telescoping mount that rotatably connects to the bracket. The bracket includes an upper arm to attach to the shelf and an connecting member to connect to the telescoping mount. The connecting member includes a pivot portion and a lock portion that are interchangeable so that the telescoping mount rotates both upwardly and downwardly depending on how it is attached to the connecting bracket. The telescoping mount is made of a first and second elongated member that are slidably connected to one another so that the device can support signs of various widths. The telescoping mount also includes a locking member to hold the elongated members in a selected position.

18 Claims, 9 Drawing Sheets

FIG. 14
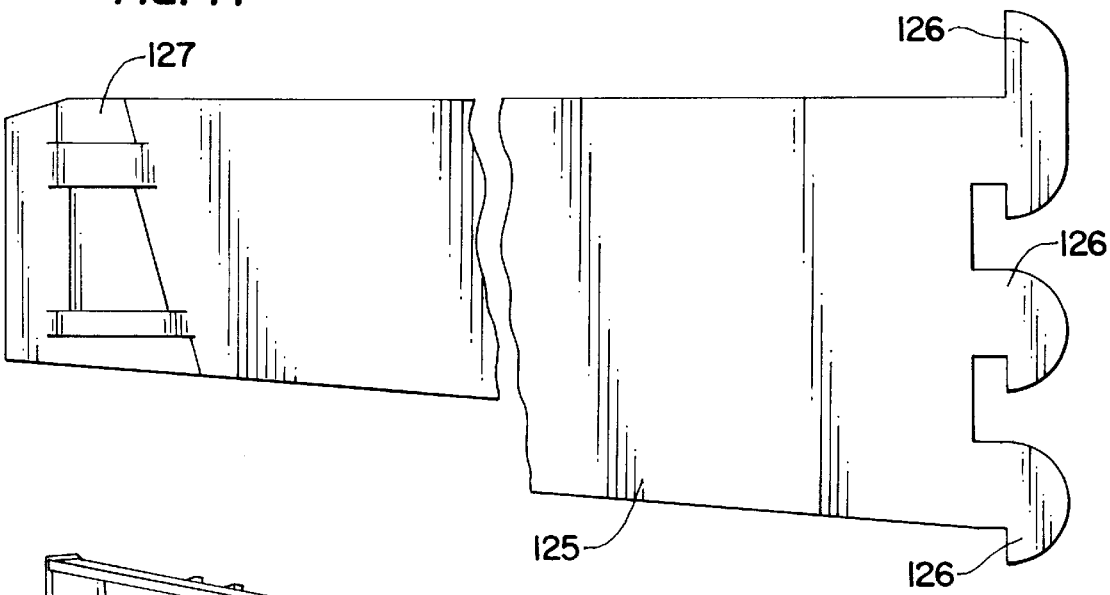
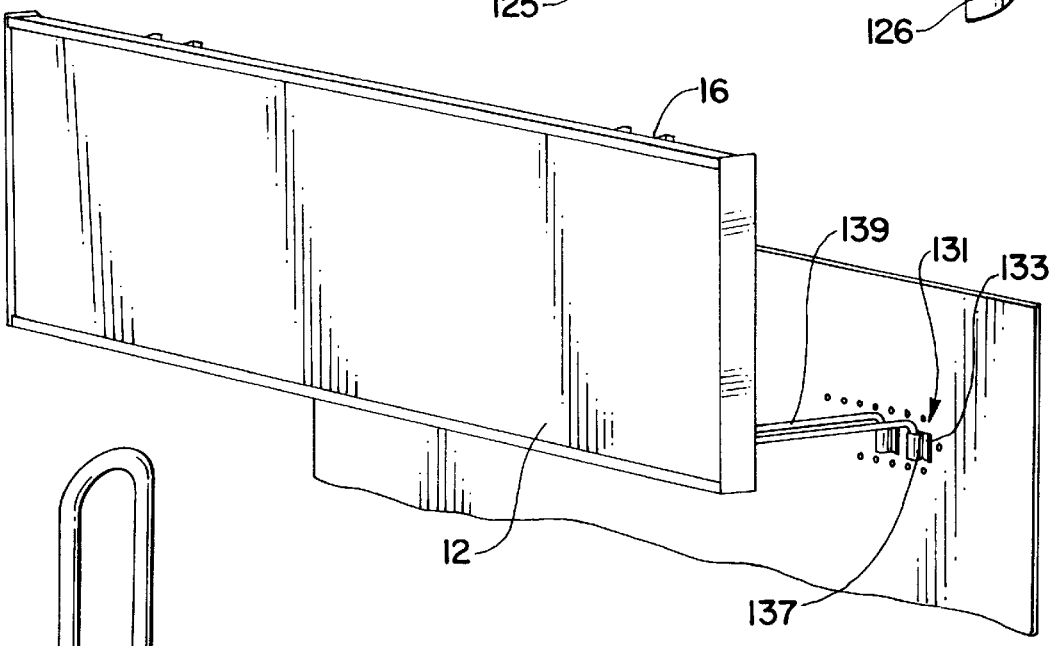
FIG. 15
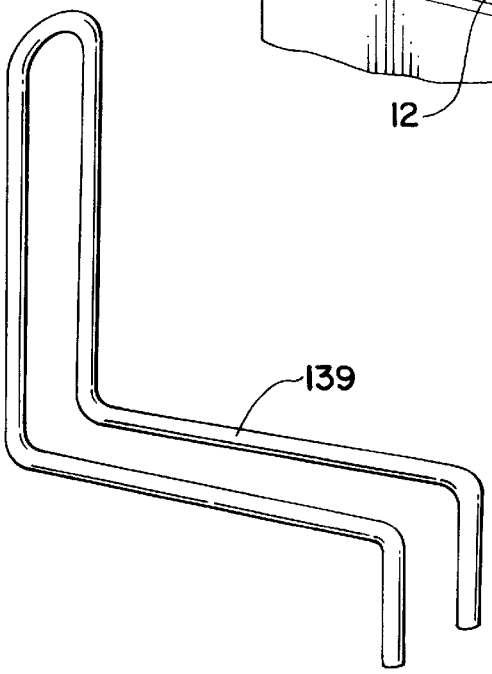
FIG. 16

UNIVERSAL SIGN MOUNTING DEVICE

BACKGROUND OF THE INVENTION

1. Field of the Invention

The present invention relates to devices that mount signs to shelving units and peg boards, and, in particular to devices that mount signs to shelves of various types wherein the signs can pivot upwardly or downwardly relative to the shelf.

2. Description of the Prior Art

In retail store locations, signs have long been attached to shelves to identify the goods on the shelf. Over the years various different system have been developed to connect the sign to the shelves. Some arrangements have the sign orthogonal to the shelves. Other arrangements have the signs vertically oriented above or below the shelves.

Depending on the type of shelving unit provided in the retail location, various different methods of connecting the sign to the shelf have been developed. The basic method consists of a C-shaped vise that attaches to the shelf. A simple sign is then attached to the vise. Other systems use a track, which is attached to shelf, and a bracket that fits into the track to support the sign. This method can also be used when the track is formed into the shelf.

The sign mounting units described also include elements that connect to the brackets and hold the sign. These elements often depend on the construction of the bracket. In the simple version, the mount and the bracket are formed out of the same material as one unit. However, this configuration prevents the sign from moving relative to the shelf. In other embodiments, the bracket and the mount are two different elements. The mounts can be rigidly connected to the bracket using screws or welds. The signs in these units also do not move relative to the shelf.

Sign mounting units can be also be constructed where the connection between the mount and the bracket allows the sign to move relative to the shelf. This is particularly beneficial when the device is used in high traffic areas and can be easily jarred. In one alternative, a movable mount allows the sign to be oriented in the best position for the consumer to see it. In this embodiment, the mount is secured to the bracket in any number of positions by a series of ratchets formed in both the bracket and the mount. In another embodiment, the sign is permitted to swing in a horizontal direction so that the unit does not break when it is struck by a consumer. In this arrangement, the connection between the mount and the bracket can include a spring to hold the mount in place and return it to its stationary position after being jarred, or the mount can be constructed out of flexible material to achieve the same purpose.

Sign units have also been developed that use multiple sides of a sign to display different messages. This type of sign is useful for check-out lines and the like. In this embodiment, the sign includes a fixed portion that can display one message, such as CLOSED, and a rotatable portion that can display another message, such as OPEN. The rotatable portion moves relative to the fixed portion so that the appropriate sign is shown to the customers.

When signs are connected to shelves as described, the signs often block certain portions of the shelving space thereby limiting the usefulness of the shelves. In order to optimize the shelf space, larger signs are often placed above the shelving unit. Alternatively, small signs can be used that fit into a track on the outer edge of a shelf. These signs, however, are often too small for consumers to read and do not provide enough space for all of the information required.

Because of the various amount of information required to be put on signs for different products, signs come in various different shapes and sizes. Signs can have long lengths and short widths, or be square. A sign mounting device must therefore be able to hold any size sign and connect to the shelf.

Not only are signs of varying shapes, sale locations have many different types of shelving units. Warehouse type stores often use pallet shelves which are relatively thick. Other stores use gondola shelves that are connected to a bracket on a wall and overstock shelves. Gondola shelves and overstock shelves are generally not as thick as pallet shelves. Other shelving units connect to peg boards and the like.

In view of the limitations of the prior art, what is needed is a sign mounting device that can connect to shelving units of various designs. It is also desired that the sign mounting device supports signs of various different sizes and can be modified to hold different size signs at different times. Furthermore, a sign mounting unit should provide access to all space behind the unit. Thereby, signs can be mounted at various locations in the shelving unit.

SUMMARY OF THE INVENTION

The present invention is a device that mounts signs to various types of shelves and which allows the sign to rotate relative to the shelf. The sign mounting device connects to any number of shelving unit designs including pallet shelving units, which are often found in warehouse retail locations, as well as a gondola shelving units and overstock shelves, which are found in more traditional retail locations. The sign mounting device made in accordance to the principles of the present invention can also be connected to the standards of a gondola shelving unit or a shelving units that uses peg boards.

The sign mounting device includes a bracket that removably attaches to the shelf of a pallet shelving unit, a gondola shelving unit or an overstock shelf. Typically, the bracket includes an upper arm that is attached to the shelf by screws or other suitable methods. A support extends perpendicular from one end of the arm. When the bracket is attached to the shelf, the support buttresses the front edge of a shelf. A lower arm can also be provided to connect with the underside of the shelf area to provide additional support for the sign mounting device.

For the bracket that connects to a pallet shelf, the support includes a ratchet portion. The ratchet portion includes a number of notches along the inner side of the support. The ratchet portion holds the lower arm to the bracket in a number of different positions separated from the upper arm, with the racket portion, the bracket can be secured to a pallet shelf of different thicknesses. A vise screw can be provided on the lower arm to firmly secure the bracket to the pallet shelf.

The bracket also includes a pivot portion and a lock portion. In one embodiment used for the pallet shelf, the pivot portion and the lock portion are connected to the side of the support opposite the ratchet portion. The pivot portion generally is made of a bar oriented orthogonal to the arms and the support and is located at one end of the support. The lock portion is generally identical to the pivot portion that is located at the opposite end of the support. The pivot portion and the lock portion can be configured to be interchangeable.

The sign mounting device also includes a telescoping mount which supports signs of various widths and lengths. The telescoping mounting unit includes a first elongated member and a second elongated member. The first and second elongated members are slidably connected together so that the mount can telescope between a number of different positions. In order to secure the telescoping in a number of different positions thereby supporting signs of various heights, a locking means is provided between the two elongated members to secure them in any number of positions. In the preferred embodiment, the first elongated member has a knob and the second elongated member includes a series of holes in which the knob fits.

At one end of the mounting unit, first elongated member includes a first clip. At the opposite end of the mounting unit, the second elongated member includes a second clip. The first and second clip are designed to hold signs of relatively short length. The first and second clips also hold a first and second extrusions to support signs of longer lengths. The extrusions can be of any size. More than one sign mounting device can be attached to the shelf thereby providing enough support for long extrusions and signs.

The first elongated member includes at least two sets of fasteners. Each set of fasteners includes an indent into each side of the first elongated member. The first set of fasteners is proximate to the end of first elongated member which includes the clip. The second set of fasteners is separated from the first set of fasteners a distance approximately the same distance between pivot portion and lock portion. The first set of fasteners removably connects to the pivot portion so that the mounting unit can rotate about the pivot portion. The second set of fasteners removably connects to the lock portion so that the telescoping mount is secured in a position against the bracket. When the second set of fasteners is connected to the lock portion, the sign is in a secured position above or below the shelf so that the sign is visible. In order for the telescoping mount to pivot relative the shelf, the second set of fasteners is removed from the lock portion while the first set of fasteners remains connected to the pivot portion. In this arrangement, the mounting unit rotates about the pivot portion so that the space behind the shelf is revealed.

As the pivot portion and the lock portion are identical, the first set of fasteners can connect to either bar and the second set of fasteners can connect to the other bar. When the first set of fasteners connects to the lower bar, thereby making the lower bar the pivot portion, the telescoping pivots downwardly. In this arrangement, the sign is typically above the shelf when the second set of fasteners is connected to the upper bar, which is the lock potion. When the first the set of fasteners connect to the upper bar, thereby making the upper bar the pivot portion, the mounting unit pivots upwardly. In this arrangement, the sign is typically below the shelf when the second set of fasteners is connected to the lower bar, which is the lock portion.

These and numerous other features and advantages of the present invention will become readily apparent from the following description, the accompanying drawings and the appended claims.

BRIEF DESCRIPTION OF THE DRAWINGS

FIG. 14 is a side view of a gondola arm used to connect the sign mounting device to the standard of a gondola shelving unit;

FIG. 15 is a perspective view of the sign mounting device of the present invention that is connected to a peg board;

FIG. 16 is a perspective view of a wire used to connect to sign mounting device to a peg board.

DETAILED DESCRIPTION OF THE PREFERRED EMBODIMENT

Figure 1:
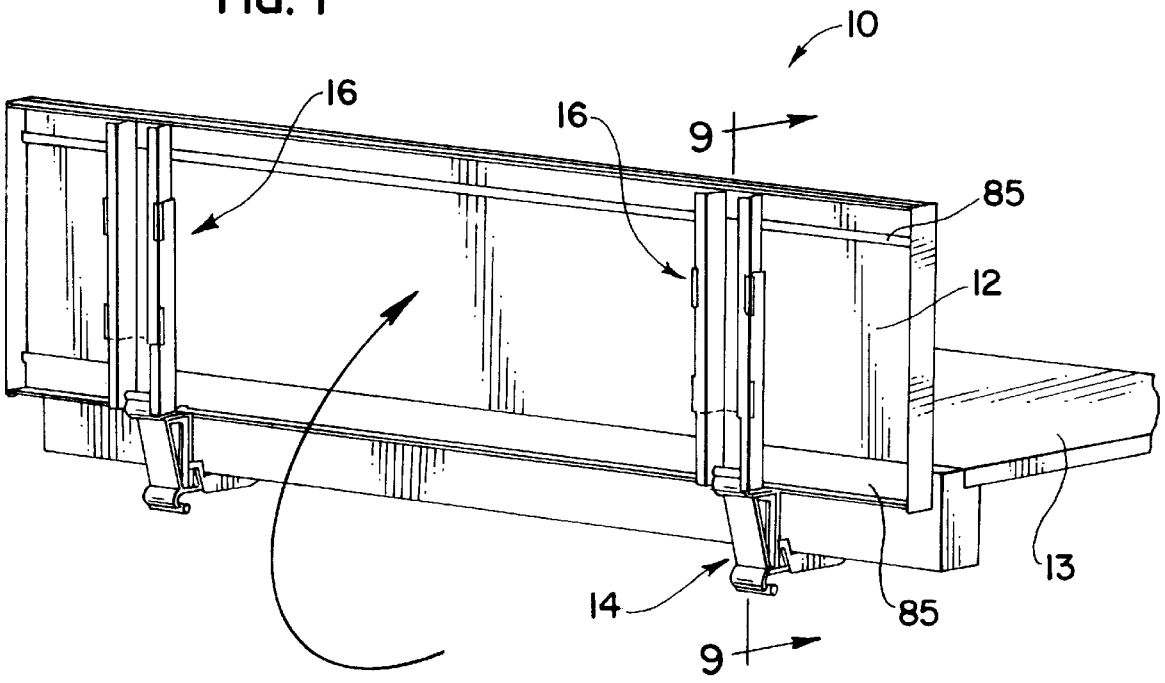
FIG. 1 is a perspective view of the sign mounting device that attaches to a pallet shelf made in accordance with the principles of the present invention and when a telescoping mount is rotated upward.

In FIG. 1, an illustration of a sign mounting device 10 made in accordance with the principles of the present invention is shown. The sign mounting device 10 of the present invention connects signs 12 of various sizes to different types shelving units. Typically, the sign mounting device 10 of the present invention is used in a retail location. The signs can be used to describe the goods placed on the shelves or used for advertisements. While FIG. 1 illustrates a sign mounting device 10 that attaches to a pallet shelf used in warehouses and warehouse retail locations, the principles of the present invention are applicable to the sign mounting devices that attach to overstock shelves, gondola shelving units, peg boards and the like.

The sign mounting device 10 shown in FIG. 1 includes a bracket 14 and a telescoping mount 16. As seen in the figures, the bracket 14 is used to removably attach the sign mounting device 10 to a shelf. The brackets 14 of various designs shown connect to different types of shelves and shelving units. Shelves come in many different shapes and sizes including pallet shelves that are typically used in warehouses and warehouse retail locations. Other types of shelves include overstock shelves and gondola shelves that are typically not as thick as a pallet shelf. The bracket 14 is also designed to be removably attached to a gondola standard, which supports gondola shelves, or to a peg board, which supports other types of shelves. The telescoping mount 16 is used to hold signs 12 of various widths and lengths.

Figure 2:
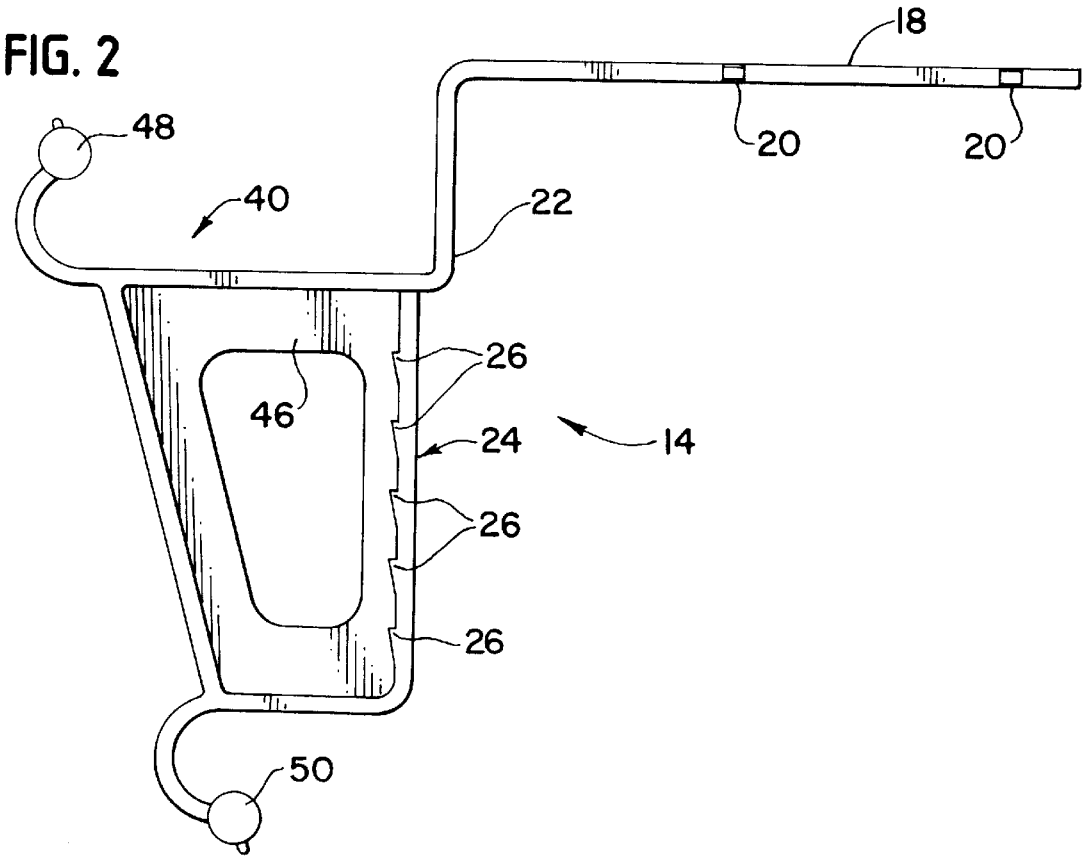
FIG. 2 is a side view of the bracket for the sign mounting device shown in FIG. 1 that attaches to a pallet shelf.

In the preferred embodiment of the present invention shown in FIGS. 1 and 2, the bracket 14 removably attaches the sign mounting device 10 to a shelf of a given thickness such as a pallet shelf. Shelves come in various thicknesses. Typically, pallet shelves are relatively thick as they are designed to support large amounts of stock as is often found in a warehouse. Furthermore, the pallet shelving units can be designed so that an entire pallet shelf can be removed from the shelving unit by a fork lift or the like, thereby creating different amounts of shelving space. Signs 12 that are used with pallet shelves can be quite large and therefore can block space behind the sign that can be used to store stock. Thus, a sign 12 that rotates to expose the space behind the sign 12 allows for easy access to the complete storage space.

The bracket 14 includes an upper arm 18 that is removably attached to the upper surface of the shelf. In the preferred embodiment, multiple notches 20 are provided along the outer edge of the arm 18. These notches 20 hold screws (not shown) that are drilled into the shelf to secure the bracket to the shelf. Of course, holes (not shown) can be provided in the upper arm 18 so that screws can secure the arm to the shelf. In order to remove the bracket 14, the screws are removed from the shelf and the bracket 14 is separated from the shelf. Rivets and the like can also be used to removably attach the bracket 14 to the shelf.

The bracket 14 also includes a support 22 that extends perpendicularly from one end of the arm 18. The length of the support 22 between the arm edge and the opposite edge is longer than the typical width of most shelves. At the upper edge of the support 22, the inner face adjacent the arm is generally smooth. This inner face is the surface that typically buttresses the outer edge of the pallet shelf when the bracket 14 is attached to the shelf. The inner face provides extra support for the bracket when it is properly attached to the shelf.

Figure 3:
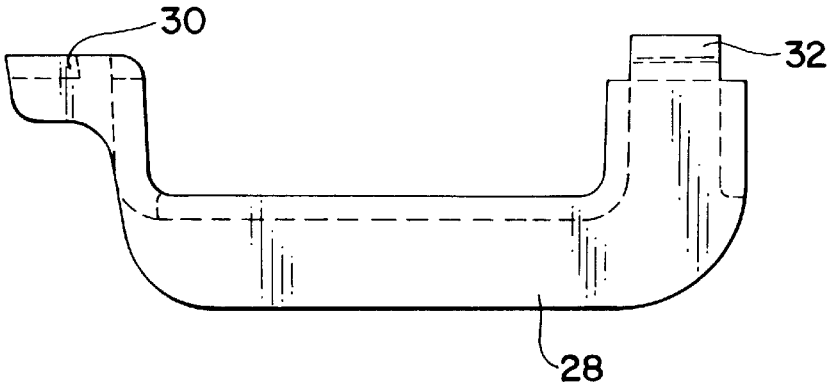
FIG. 3 is a side view of the lower arm of the bracket shown in FIG. 2.

At the lower end of the support 22, the bracket 14 includes a ratchet portion 24. The ratchet portion 24 has series of notches 26 along the inner face of the support. In the preferred embodiment, the notches 26 are triangular. The ratchet portion 24 supports a lower arm 28 of the bracket 14, as seen in FIG. 3, that buttresses the under side of the pallet shelf. As one pallet shelf can be any width, and the ratchet portion 24 allows the lower arm 28 to be placed in a series of positions relative to the upper arm 18 allowing the bracket 14 to surround the shelf in a C-shape fashion. The lower arm 28 includes a mating portion 30 at one end that removably connects to the notches 26 of the ratchet portion 24. At the opposite end of the arm 28, a vise screw 32 can be provided thereby compensating for discrepancies between shelf widths and the space between the upper and lower arms of the bracket provided by the ratchet portion 24. The vise screw 32 rotates into the under side of the shelf to secure the lower arm 28 against the shelf. With the vise screw 32, the bracket 14 is firmly attached to the shelf to hold a sign.

On the outer face of the support 22, the bracket 14 has an element for telescoping mount to connect to the bracket. The connecting element 40 includes a pivot portion and a lock portion. The connecting element 40 is separated from the support 22 by an extension 46 which provides enough distance between the shelf and the sign 12 so that the sign 12 can rotate about the pivot portion. In the preferred embodiment, the upper edge of the extension 46 is longer than the lower edge of the extension 46 so that the outer edge is angled relative the support 22. In the preferred embodiment, the pivot portion and the lock portion are interchangeable so that the telescoping mount 16 can rotate either upwardly or downwardly depending on how the mount 16 is attached to the bracket 14. As seen in FIG. 2, the connecting element 40 includes a first bar 48 that is elevated above the upper edge of the extension 46. Descending below the lower the edge of the extension, the connecting element includes a second bar 50 essentially identical to the first bar 48. In the preferred embodiment, both the first and second bars 48, 50 are cylindrical so that either bar can be the pivot portion and the telescoping mount 16 can rotate about either bar. Because the outer edge of the extension 46 is angled, the distance between the support 22 and the first bar 48 is greater than the distance between the support 22 and the second bar 50. This arrangement allows the sign 12 to be oriented at an angle relative the shelf.

Figure 4:
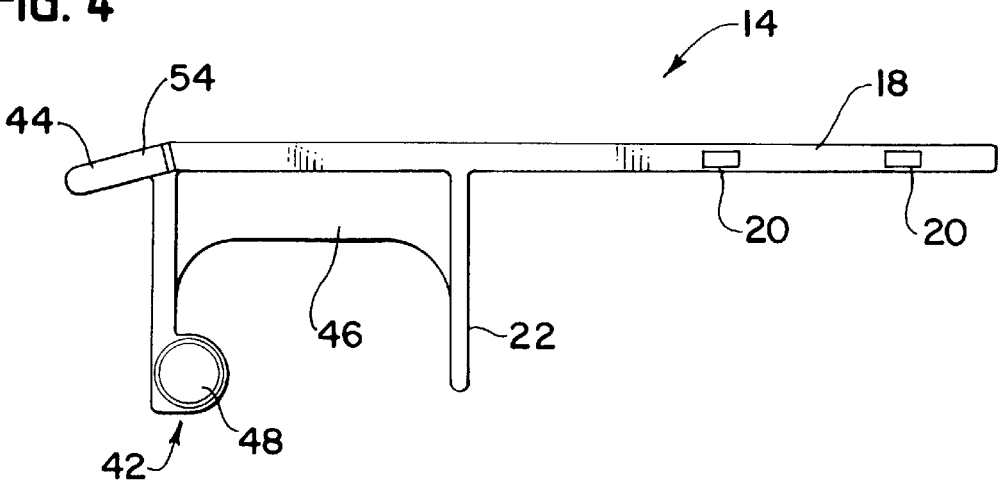
FIG. 4 is a side view of an alternative embodiment of a bracket shown in FIG. 1 that attaches to a overstock shelf or a gondola shelf.

In FIG. 4, an alternative embodiment of the bracket 14 shown in FIG. 2 is shown. This embodiment of the bracket can be used to attach the sign mounting device 10 to a pallet shelf, and because of its size and design can also be used to removably attach the bracket to a gondola or an overstock shelf. The embodiment of the bracket shown in FIG. 4 does not include a ratchet portion 24 or a lower arm 28.

In an alternative embodiment of the bracket 14 shown in FIG. 4, the upper surface of the extension 46 can extend out from the upper arm 18. At the outer edge of the extension's upper surface a lock portion 44 can be positioned. This lock portion 44 is a straight bar with tabs 54 at the outer edges. Below the lower edge of the extension 46, pivot portion 42 is oriented. The pivot portion 42 is a cylindrical bar so that the telescoping mount 16 can rotate relative to the shelf. In this arrangement, the telescoping mount 16 rotates downwardly. In another embodiment, the pivot portion 42 extends out from the upper surface of the extension 46 and the lock portion 44 extends below the lower surface. In this embodiment, the telescoping mount 16 rotates upwardly relative to the shelf.

Figure 5:
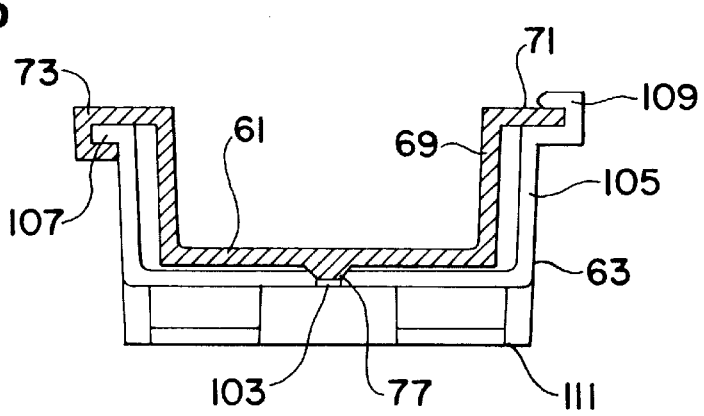
FIG. 5 is an end view of the telescoping mount used to support a sign that is made in accordance with the principles of the present invention.

In FIG. 5, the end view of the telescoping mount 16, which holds signs of various sizes, of the preferred embodiment is shown. The telescoping mount 16 includes a first elongated member 61 and a second elongated member 63 that are slidably connected to one another. The first and second elongated members 61, 63 are secured in any number of positions relative to one another by a locking element 65. As can be seen, both the first and second elongated members 61, 63 have a general rectangular shape.

Figure 6:
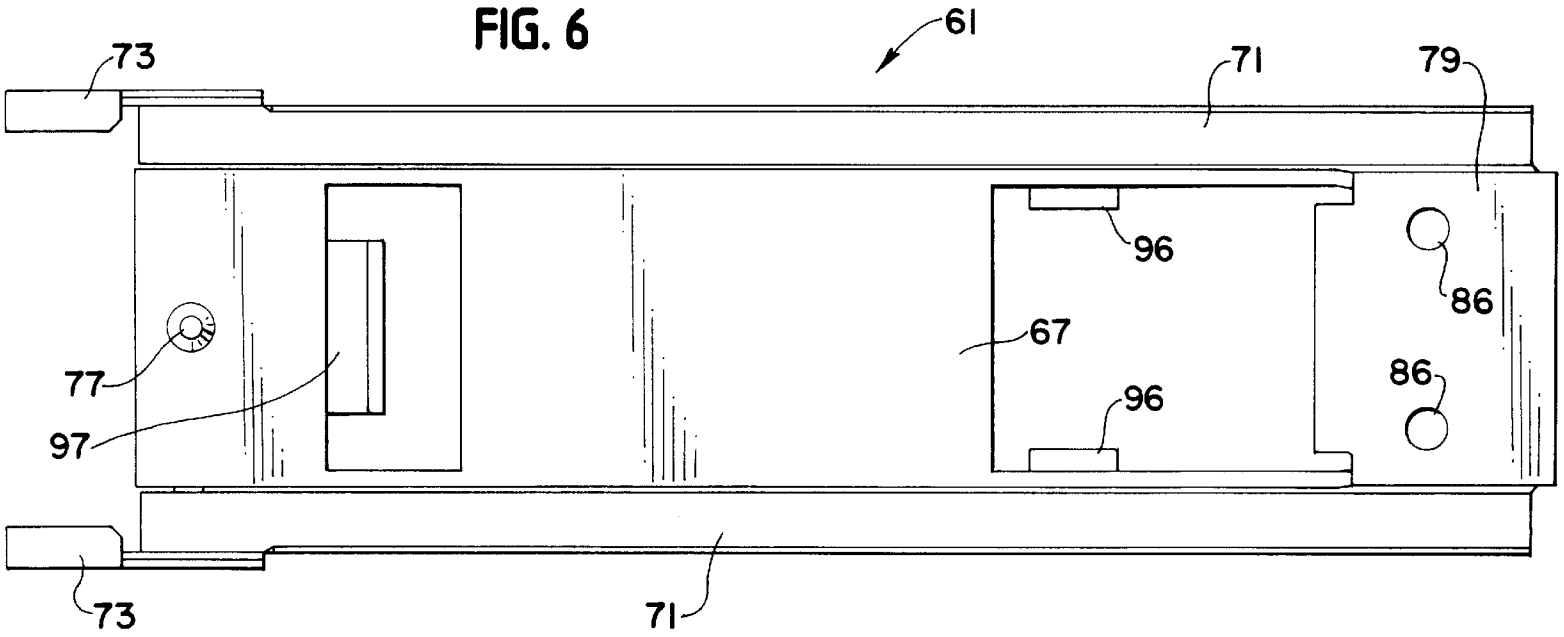
FIG. 6 is a top view of the first elongated member of the telescoping mount shown in FIG. 5.
Figure 7:
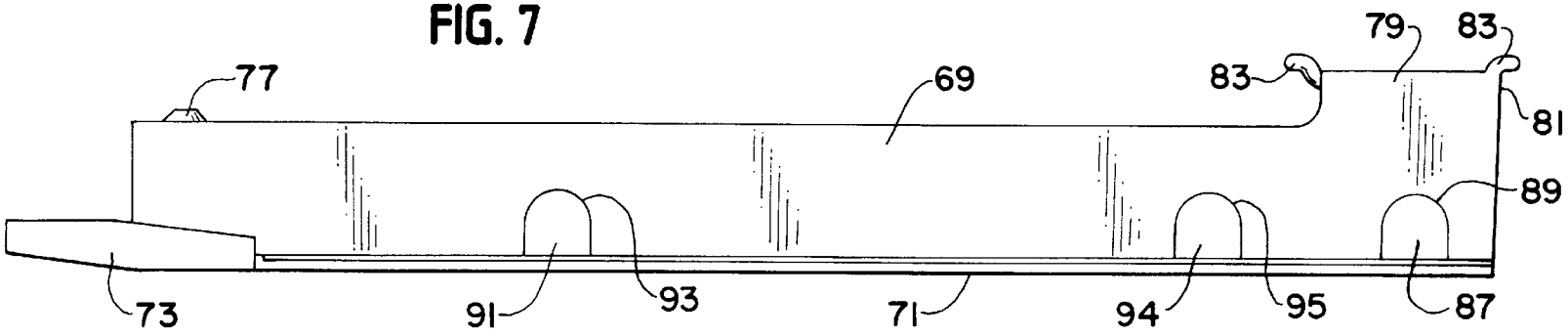
FIG. 7 is a side view of the first elongated member.

In FIGS. 6 and 7, a top and side view of the first elongated member 61 are shown, respectively. The first elongated member has a top surface 67. Perpendicular to each long edge, the member has two sides 69. At the opposite edge from the top surface 67, two tracks 71 extend generally perpendicular to the sides 69 and generally parallel to the top surface 67. A cross section of a side has a Z-shape. At the end of the first elongated member 61 corresponding to the center of the telescoping mount 16, the tracks 71 extend beyond the edge and convert into a channel 73. The channels 73 function with the second elongated member 63 so that the two members stay together as a telescoping mount 16.

Along its top surface 67 and proximate the edge corresponding to the channels 73, the first elongated member 61 includes a knob 77 which makes up a part of the locking element 65. The top surface 67 of the first elongated member 61 also has a clip 79 at the end opposite of the knob 77. The clip 79 includes two tongues 81 extending up from the top surface, and each tongue has an angled end 83. These ends 83 point in opposing directions from the other. The clip 79 can support a sign 12 of a relatively short length. For longer signs, the clip removably holds an extrusion 85, shown in FIG. 10, that supports the sign 12. The clips have holes 86 to hold rivets (not shown) that are used to secure extrusions 85 to the clips.

Proximate the edge corresponding to the clips 79, each side 69 includes an indent 87 that form a first set of fasteners 89. In the preferred embodiment, the first set of fasteners 89 are approximately the same size as the bar of the pivot portion 42. In this configuration, the first set of fasteners 89 can be removably connected to the pivot portion 42. As the first set of fasteners 89 is oriented towards one end of the telescoping mount 16, the telescoping mount 16 rotates about the pivot portion 42 at that end of the first elongated member 61. A second pair of indents 91 are positioned on the sides of the first elongated member 61 a distance from the first set of fasteners 89 equal to the distance between the bars of the connecting element 40. The second pair of indents 91 form a second set of fasteners 93 that removably connect to the lock portion 44. When the second set of the fasteners 93 are connected to the lock portion 44, the telescoping mount 16 is secured to the bracket 14 so that it will not rotate about the pivot portion 42. The first elongated member 61 can also be configured with a third pair of indents 94 that are positioned between the first pair of indents 87 and the second pair indents 91 the third pair of indents 94 are positioned a distance from the first pair of indents 87 equal to the distance between the pivot portion 42 and the lock portion 44 of the bracket shown in FIG. 4. The third pair of indents 94 form a third set of fasteners 95 that removably connect to the lock portion 44 when the first set of fasteners 89 are removably connected to the pivot portion 42.

On the inner surface of each sides 69, a channel 96 is positioned between the first and second indent 87, 91. Proximate the end of the first elongated member 61 opposite the first set of fasteners 89, a hook descends below the top surface 67. The channel 96 and hook 97 are used by the telescoping mount 16 to connect to a peg board or the standard of a gondola, as described below.

Figure 8:
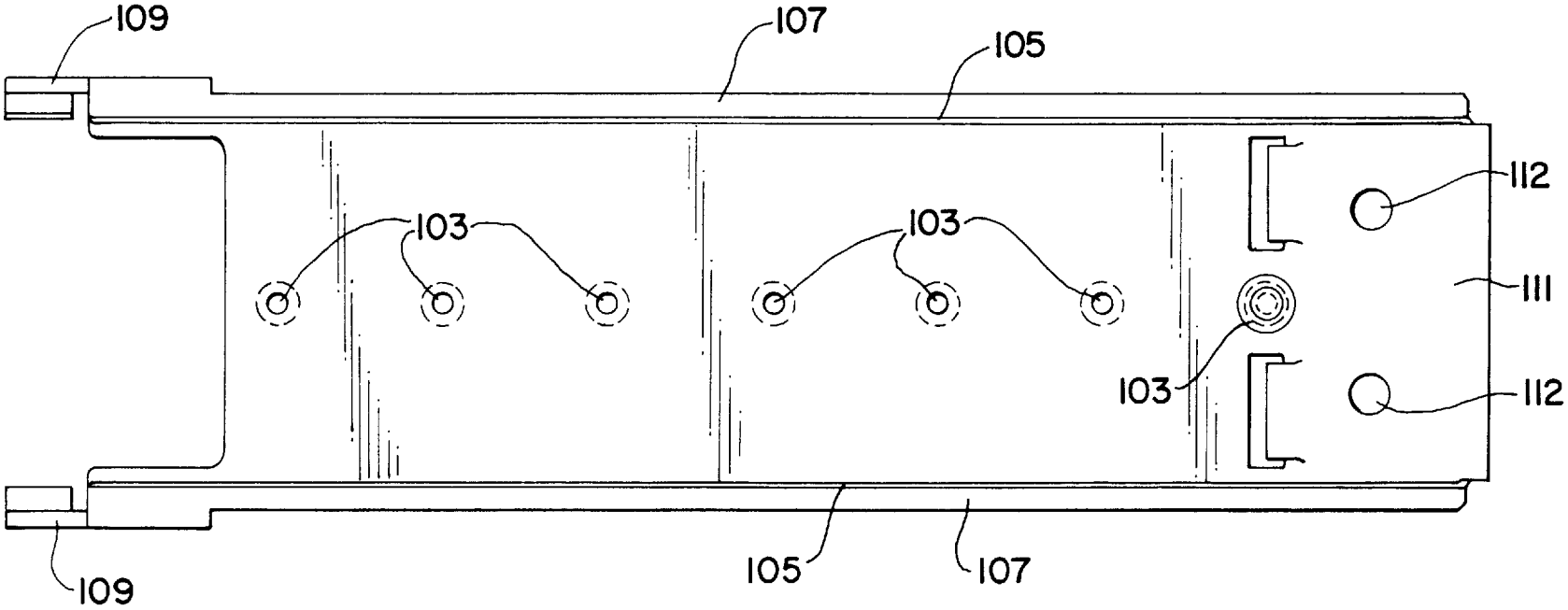
FIG. 8 is a top view of the second elongated member of the telescoping mount shown in FIG. 5.

Now referring to FIG. 8, the second elongated member 63 also includes an upper surface 101. Evenly spaced along the upper surface 101, the second elongated member has a series of holes 103 which form another part of the locking element 65. The size of the holes 103 corresponds to the size of the knob 77 on the first elongated member 61. Accordingly, the knob 77 fits into any of the holes 103 thereby allowing the telescoping mount 16 to be secured in to any number of positions. Accordingly, the telescoping mount 16 hold signs 12 of various heights.

The second elongated member 63 has sides 105 extending perpendicular to the upper surface 101. At the opposite end of each side 105, the second elongated member 63 has two tracks 107 similar to the tracks 71 of the first elongated member 61. The tracks 107 are generally perpendicular to the sides 105 and generally parallel with the upper surface 101. As with the first elongated member 61, the cross-section of an edge of the second elongated member 63 has a Z-shape.

At the end of the second elongated member 63 corresponding to the center of the telescoping mount 16, each track 107 of the second elongated member extends into a channel 109. The track 71 of the first elongated member 61 described above fits into the channel 109 of the second elongated member 63. The track 107 of the second elongated member 63 fits into the channel 73 of the first elongated member 61. With this configuration, the first and second elongated members 61, 63 are slidably connected to one another. The knob 77 and holes 103 of the locking element 65 secure the members into any of a number of positions to support signs 12 of varying widths.

At the end opposite the channel 109, the upper surface 101 of the second elongated member 63 has clip 111 similar to the clip 79 connected to the first elongated member 61. As with the other clip 79, the clip 111 on the second elongated member 63 supports signs 12 of relatively short lengths, and in order for the sign mounting device 10 to hold longer signs 12, an extrusion 85 snaps onto the clip 111. Similar to the clip 79 which is a part of the first elongated member 61, clip 111 includes holes 112 to hold rivets (not shown) that secure the extrusion 85 to the second elongated member 63.

Figure 9:
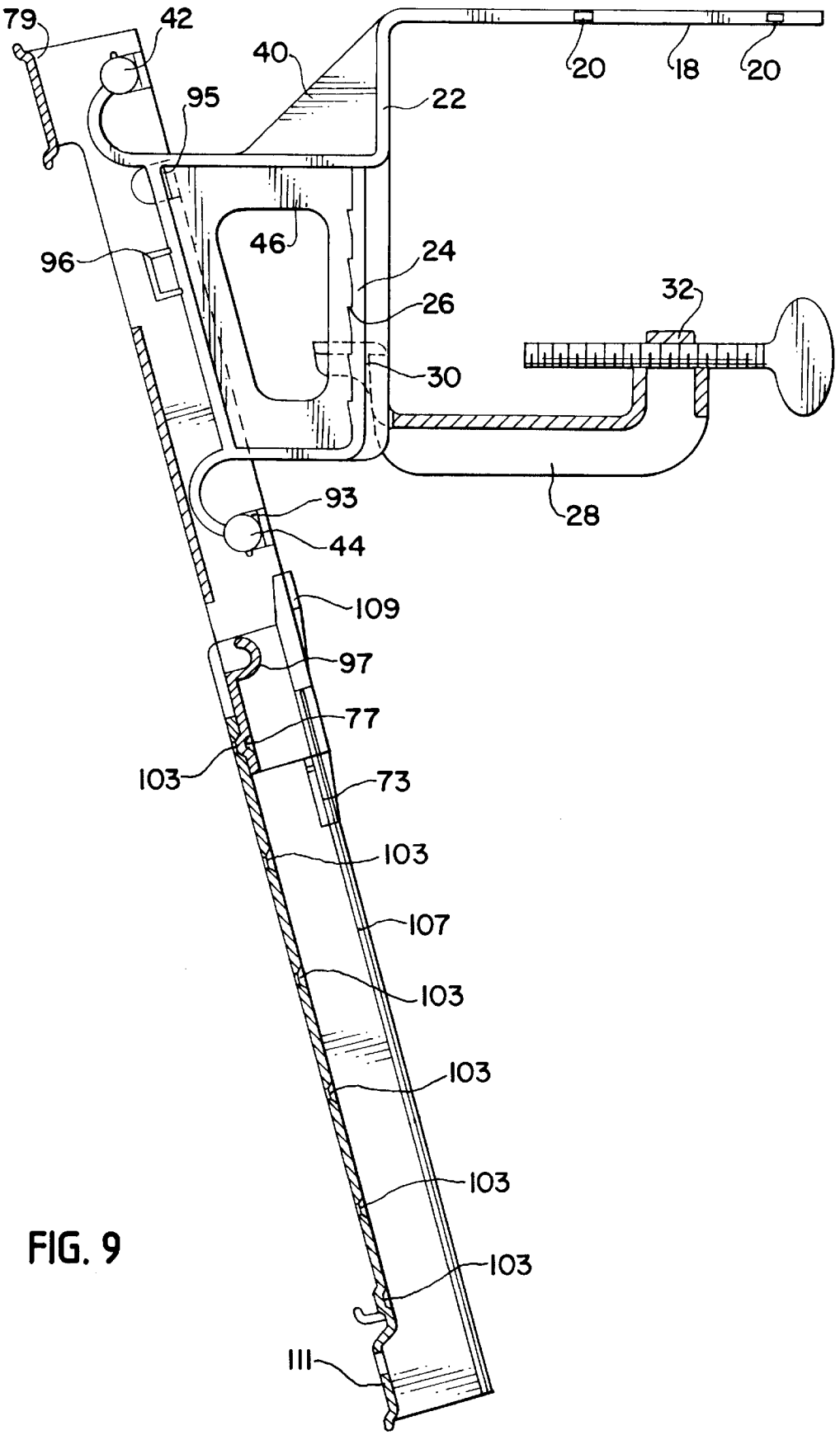
FIG. 9 is a cross sectional view of the sign mounting device taken along the line 9—9 in FIG. 1.

FIG. 9 illustrates the telescoping mount 16 formed from a slidably connected first and second elongated member 61, 63 connected to the bracket 14. The telescoping mount 16 is in its completely extended position. The track 71 of the first elongated member 61 is in the channel 109 of the second elongated member 63, and the track 107 of the second elongated member 63 is in the channel 73 of the first elongated member 61. The knob 77 is inserted into the last hole 103 in the series. As seen, the first set of fasteners 89 is connected to the first bar 48, thereby making the first bar 48 the pivot portion 44. The second set of fasteners 93 is connected to the second bar 50, thereby making the second bar 50 the lock portion 46. The clips 79, 111 at either end of the telescoping mount 16 secure a sign 12 or an extrusion 85 to the device 10.

Figure 10:
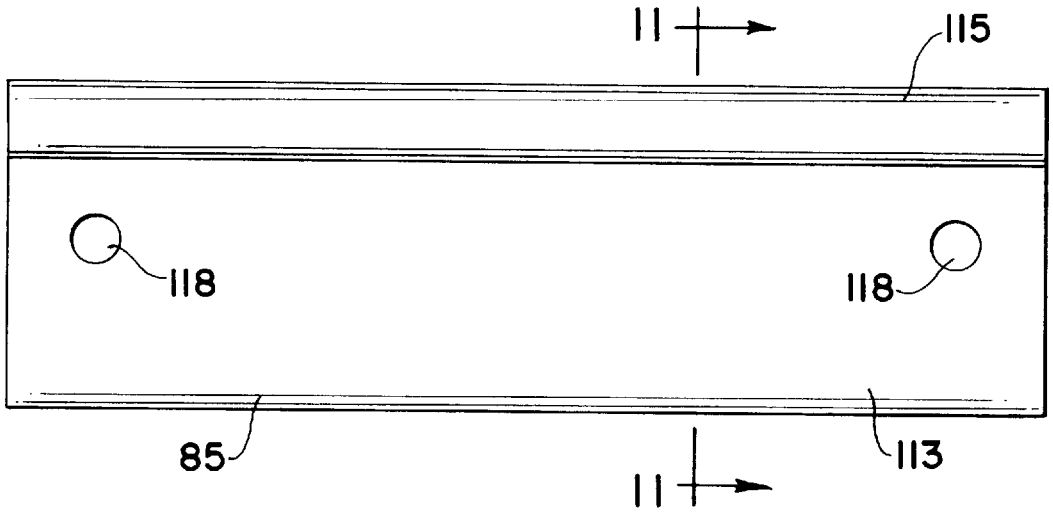
FIG. 10 is a front view of a single sided extrusion made in accordance with the principles of the present invention.
Figure 11:
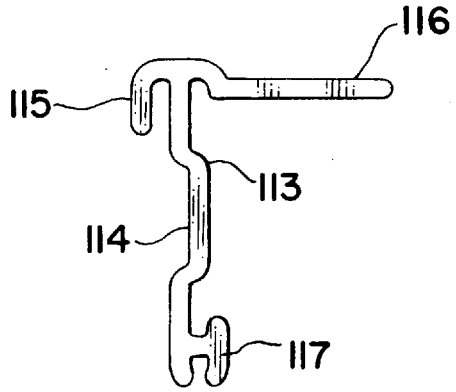
FIG. 11 is a cross sectional view of the single sided extrusion taken along the line 11—11 in FIG. 10.
Figure 12:
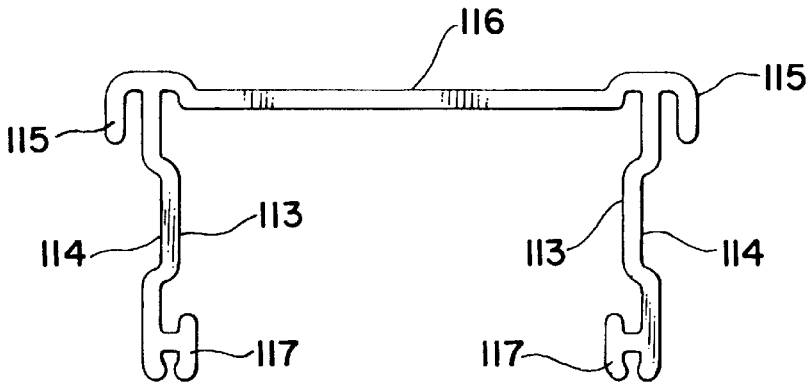
FIG. 12 is a cross sectional view of double sided extrusion similar to the single sided extrusion shown in FIG. 10.

FIGS. 10 and 11 illustrate an extrusion 85 used to connect to the clips 79 and 111. Extrusions 85 vary in length depending on the size of the sign 12 supported by the device 10. Each extrusion 85 has a back surface 113 with a wide groove 114 running the length of the extrusion 85. At the top edge, an L-shaped flange 115 extends in front of the back surface 113, The L-shaped flange 115 serves to support an edge of the sign 12 in the extrusion 85. On the other side of the extrusion, a shelf 116 extends the length of the extrusion 85 from the top edge of the back surface. The bottom edge of the extrusion 85 has a T-shaped flange 117. The combinations of the wide groove 114, the shelf 116, and the T-shaped flange 117 fit into the clips 79, 111 of the first and second elongated members 61, 63. At each end of the extrusions 85, a hole 118 is provided that corresponds to the holes 86, 112 in the clips. Rivets (not shown) fit through the holes in both the extrusion and the clips to secure the extrusion 85 to the mount 16. An alternative embodiment of the extrusion 85 is shown in FIG. 12 that has two sides which are mirror images of each other. This extrusion supports signs 12 on two sides of the shelving unit.

Figure 13:
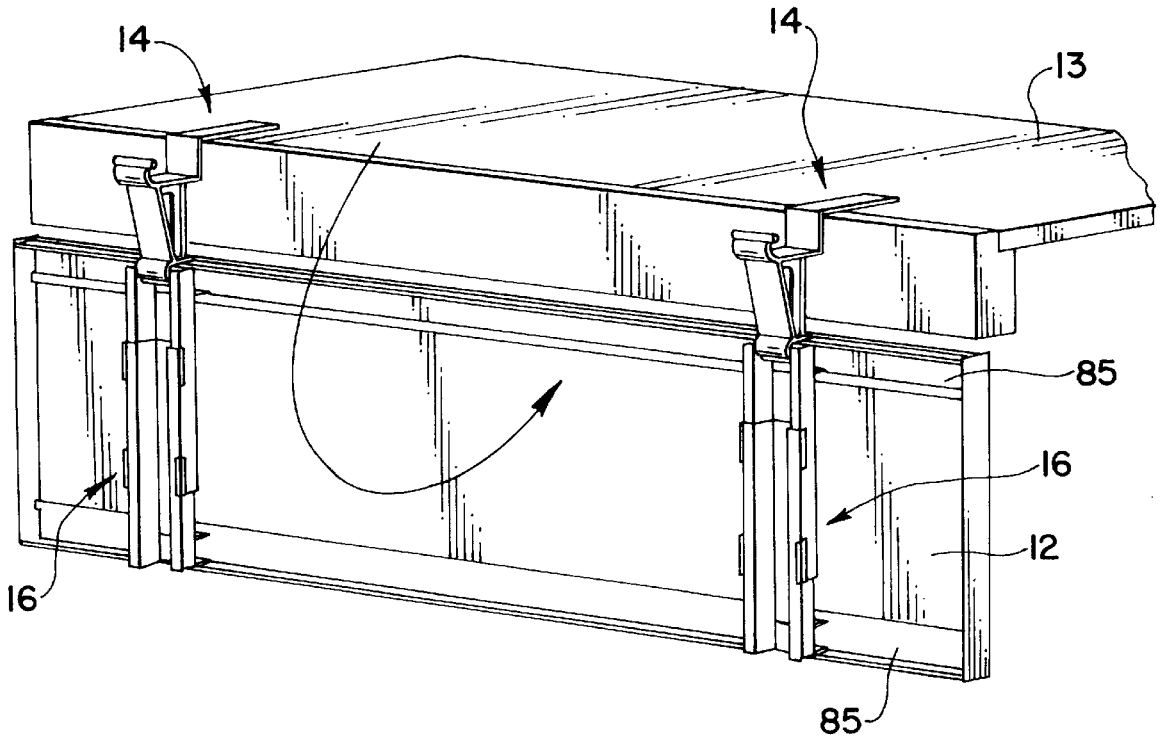
FIG. 13 is a perspective view of the sign mounting device made in accordance with the principles of the present invention when the telescoping mount is rotated downward.

In the arrangement of the device 10 shown in FIG. 9, the sign 12 extends below the shelf, and the telescoping mount 16 can rotate upwardly about the pivot portion 44, or the first bar 48, so that the sign 12 is above the shelf. An illustration of the telescoping mount 16 in the upwardly rotated position is shown in FIG. 1. Of course, the first set of fasteners 89 can be secured to the second bar 50 and the second set of fasteners 93 can be secured to the first bar 48 so that the sign 12 extends above the shelf when the telescoping mount 16 is in the locked position. In this configuration, the telescoping mount 16 rotates downwardly about the pivot portion 44, or the second bar 50, so that sign 12 is below the shelf. An illustration of the telescoping mount 16 in the downwardly rotated position is shown in FIG. 13.

In another embodiment of the present invention, the device 10 is connected to the standard of a gondola shelving unit. As is known in the prior art, the standard of a gondola shelving unit is attached vertically to a wall and extends between the ceiling and the floor. Evenly spaced throughout the standard are a series of notches. In order to connect to the standard 120, the bracket 14 is an arm 125 of the type shown in FIG. 14. The arm includes a series of tabs 126 that fits into the notches 124. The tabs 126 lock into the notches 126 thereby securing the bracket 14 to the standard 120. At the opposite end from the tabs 124, the arm 125 includes a dual slot system 127 into which the wire mount (described below fits). The dual slot system 127 is configured so that the wire mount can fit into one of two positions so that the sign will have a vertical or angled orientation. The telescoping mount 16 is of the type described.

Figure 17:
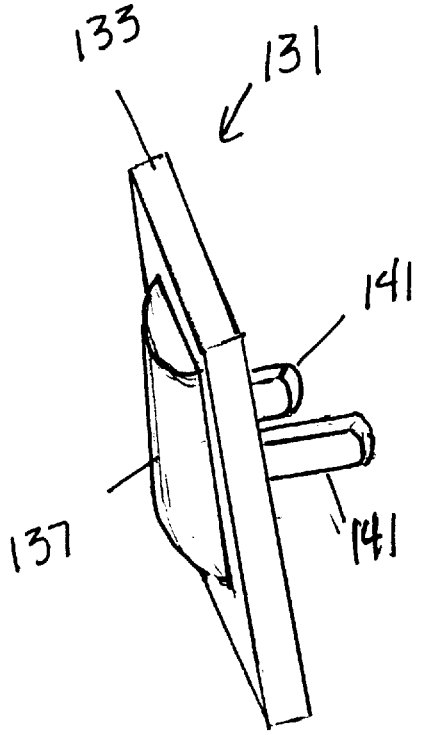
FIG. 17 is a perspective view of a clip that is shown in FIG. 16.

FIG. 15 shows an embodiment of the device that connects to a peg board. The bracket 14 in this embodiment include a clip 131 as seen in FIG. 17 that fits into the peg board. The clip 131 includes a flat plate 133 that can be placed against the peg board. On one side of the plate, at least two pegs 141 are provided that fit into the holes of the peg board. With the pegs 135 inserted into the board, the clip 131 is secured to the board. On the opposite side of the plate 133, a channel 137 is provided. One end of a double bended Z-shaped wire mount 139, shown in FIG. 16, fits into the channel 137 to support the wire to the peg board. The other end of the wire 139 supports the telescoping mount 16 by fitting into the channels 95 and the hook 97 on the inner surface of the first elongated member 61.

Of course, various changes and modifications of the preferred and alternative embodiments described will be apparent to one skilled in the art. Such changes can be made without departing from the spirit and scope of the invention and without diminishing its attendant advantages. It is, therefore, intended that such changes and modifications be covered by the appended claims.

What is claimed is:

1. A device for removably attaching a sign to a shelf, the device comprising:

a bracket to removably attach the device to the shelf, wherein the bracket includes an interchangeable pivot portion and lock portion;

a mount to support the sign to the device and which removably connects to the bracket so that the sign can rotate upwardly and downwardly about the pivot portion, the mount further comprising a first elongated element to connect the mount to the bracket;

a second elongated element slidably connected to the first elongated element to allow the mount to telescope to support signs of varying sizes.

2. The device according to claim 1 wherein the bracket further comprises:

an upper arm to removably attach the bracket to an upper surface of the shelf; and an adjustable underarm to secure the device to the shelf, wherein the underarm removably attaches to the bracket and adjusts the size of the bracket to the size of the shelf.

3. The device according to claim 2 wherein the bracket further includes a ratchet to removably attach the underarm in any one of a series of adjustable positions relative to the upper arm to adjust the size of the bracket to the size of the shelf.

4. The device according to claim 1 wherein the pivot portion includes a first bar and the lock portion includes a second bar, wherein the mount rotates about the first bar and the mount is secured in a position by the second bar.

5. The device according to claim 1 wherein the mount includes a first fastener to connect the mount to the pivot portion and a second fastener to connect the mount to the lock portion.

6. The device according to claim 1 wherein the first elongated member includes a first clip and the second elongated member includes a second clip, and wherein the first and second clips each hold an extrusion so that the mount is capable of supporting signs of varying lengths.

7. A device for removably attaching a sign to a shelf, the device comprising:

a bracket to removably attach the device to the shelf, wherein the bracket includes an interchangeable pivot and lock portion; and a mount movably connected to the interchangeable pivot and lock portion and wherein the mount includes a first elongated member and a second elongated member slidably connected to the first elongated member, wherein the connection between the first and second elongated members allows the mount to telescope.

8. The device according to claim 7 wherein the first elongated member includes a first fastener to rotatably connect the mount to the interchangeable pivot and lock portion so that the mount rotates about the bracket.

9. The device according to claim 8 wherein the first elongated member has a second fastener to connect the mount to the interchangeable pivot and lock portion and secure the mount in a position when the first fastener is connected to the interchangeable pivot and lock portion.

10. The device according to claim 9 wherein the interchangeable pivot and lock portion has a first bar to connect to the first fastener and a second bar to connect to the second fastener and wherein the mount can rotate upwardly and downwardly about the first bar.

11. The device according to claim 7 wherein the first elongated member has a first and second elongated side and includes a track along the first and second elongated side of the first elongated member and wherein the second elongated member has a first and second elongated side and includes a channel at one end of the first and second elongated sides of the second elongated member, wherein the tracks fit into the channels to slidably connect the first elongated member to the second elongated member.

12. The device according to claim 7 wherein the first elongated member includes a knob proximate one edge and the second elongated member includes a series of holes wherein the knob fits into any hole in the series of holes.

13. The device according to claim 7 wherein the first elongated member includes a first clip and the second elongated member includes a second clip wherein the clips is capable of supporting the sign.

14. The device according to claim 13 wherein the first and second clips each support an extrusion so that the mount is capable of supporting signs of various lengths.

15. A device to rotatably attach a sign to a shelving unit, the device comprising:

a bracket to connect the device to the shelving unit, wherein the bracket includes an interchangeable pivot and lock portion;

a mount having a first elongated member slidably connected to a second elongated member so that the mount telescopes to support signs of varying widths, wherein the mount is movably connected to the interchangeable pivot and lock portion;

a first extrusion removably attached to the first elongated member; and a second extrusion removably connected to the second elongated member wherein the first and second extrusions are capable of supporting a sign of varying lengths.

16. The device according to claim 15 wherein the bracket comprises:

an upper bar for removably securing the device to the shelving unit;

a ratchet portion connected at a first end thereof to the upper bar;

a lower bar movably connected to the ratchet portion and for connecting to the under side of the shelving unit; and wherein the mount removably connects to the interchangeable pivot and lock portion so that the mount rotates about the pivot portion and removably connects to the lock portion to secure the mount in a position.

17. The device according to claim 15 wherein the bracket comprises:

an upper bar to be removably secured to the shelving unit; and a support bar perpendicular to the upper bar to support the device against the shelving unit.

18. The device according to claim 15 wherein the bracket comprises:

at least two clips for connecting the device to the shelving unit including a flat portion and having at least one peg on one side of the flat portion; and a wire fork portion having two tongs at one end that fit into the clips and a support parallel to the tongs at the other side of the fork, wherein the support connects to the mount.

* * * * *